United States Patent [19]

Della Torre

[11] Patent Number: 4,482,143

[45] Date of Patent: Nov. 13, 1984

[54] DEVICE FOR SENSING REMOVAL OF STACKED WORKPIECES

[75] Inventor: Giancarlo Della Torre, Milan, Italy

[73] Assignee: Rockwell-Rimoldi S.p.A., Italy

[21] Appl. No.: 465,958

[22] Filed: Feb. 14, 1983

[30] Foreign Application Priority Data

May 17, 1982 [IT] Italy ..... 21310 A/82

[51] Int. Cl.[3] ..... B65H 3/22

[52] U.S. Cl. ..... 271/18.3; 271/153; 271/258

[58] Field of Search ..... 271/18.3, 103, 107, 271/153, 258

[56] References Cited

U.S. PATENT DOCUMENTS 3,966,197 6/1976 Riedl ..... 271/103

4,165,811 8/1979 Mainvielle ..... 271/18.3 X

*Primary Examiner*—Richard A. Schacher

[57] ABSTRACT

A device for sensing the removal of workpieces from a stack by a pickup head which, during its intended function, is lowered to engage the upper workpiece in a stack, then elevated to remove the workpiece and then rotated so the workpiece can be deposited in a preselected location. The sensing device is pivotably mounted on the pickup head and movable between positions below the underside of the pickup head when the latter fails to engage a workpiece and at a level even with the underside of the pickup head which is accomplished through its engagement with a workpiece held by the pickup head. Upon engagement and pick up of a workpiece, a signal is given to raise the pickup head and then rotate it so the workpiece can be deposited in a predetermined location. Upon failure to engage and remove a workpiece from a stack, a signal is given for the pickup head to make a plurality of repeated attempts to engage and remove a workpiece from the stack. After a predetermined number of failures of the pickup head to perform its intended function, a warning signal is activated for the purpose of drawing attention thereto.

5 Claims, 5 Drawing Figures

DEVICE FOR SENSING REMOVAL OF STACKED WORKPIECES

BACKGROUND OF THE INVENTION

1. Field of the Invention

The present invention pertains to a device for sensing the engagement of a pickup head having gripping means with stacked workpieces in sheet form, such as fabric, plastic, paper and the like.

With such a device, it is possible to detect failure of a pickup head to engage a workpiece, resulting in activation of a warning signal that indicates that workpieces are not being removed from the stack. Such a signal can be timed to initiate the cessation of operation of the pickup head, which is first caused to be lowered to engage and grip a workpiece, then raised to remove the workpiece from the stack and thence rotated so the workpiece can be released to be deposited in a predetermined location.

2. Description of the Prior Art

A device for picking up workpieces by means of one or more pickup heads having fixed and movable teeth that are caused to penetrate the thickness of a workpiece to be removed are shown and described in U.S. patent application No. 377,285, filed on May 12, 1982 by the applicant of this application, and assigned to the assignee of the present invention. Additionally, these types of pickup heads can be provided with gripping elements that define adhesive members attached to the underside of the pickup heads.

The known devices for separate and individual removal of workpieces from a stack perform their intended functions quite satisfactorily on many types of workpieces; however, they are considered to have certain disadvantages by not being able to detect failure of the device to engage and grip a workpiece, which can be attributed to the type of material from which it is made, or by a malfunction of the gripping means. In either case, conditions of this nature are not immediately detected by the operator who otherwise would be able to intervene and correct such conditions.

The device comprising the invention provides a means for overcoming the disadvantages of known devices by a sensing apparatus which immediately detects and warns the operator when the device fails to remove a workpiece from the stack.

SUMMARY OF THE INVENTION

The device according to the invention defines a movable sensing element pivotably mounted on each pickup head. With the pickup heads in an elevated position, the movable sensing elements extend below the underside of the pickup heads that are provided with the workpiece gripping elements. The pickup heads are first lowered to engage and grip a workpiece and then raised to remove the gripped workpiece and, finally, rotated so the removed workpiece can be deposited in a preselected location. When a pickup head is raised with a workpiece, the movable sensing element is supported thereby and the device completes the cycle of depositing the workpiece in the preselected location. If the pickup head fails to remove a workpiece when raised, the movable sensing element pivots to a location below the underside thereof whereat it initiates a signal for the pickup head to make a plurality of decending movements in an attempt to engage and grip a workpiece for removal from the stack. If the pickup head fails to grip a workpiece after a plurality of attempts, a warning signal is given which enables the operator to take the necessary steps to correct the condition.

It is a general object of the invention to provide a device for sensing the engagement and removal of a workpiece from a stack.

A further object is to provide a device that will signal an operator on failure of the device to remove a workpiece from the stack.

These and other objects of the invention will become more fully apparent by reference to the appended claims and as the following detailed description proceeds in reference to the figures of drawings wherein:

DESCRIPTION OF THE PREFERRED EMBODIMENT

Figure 1:
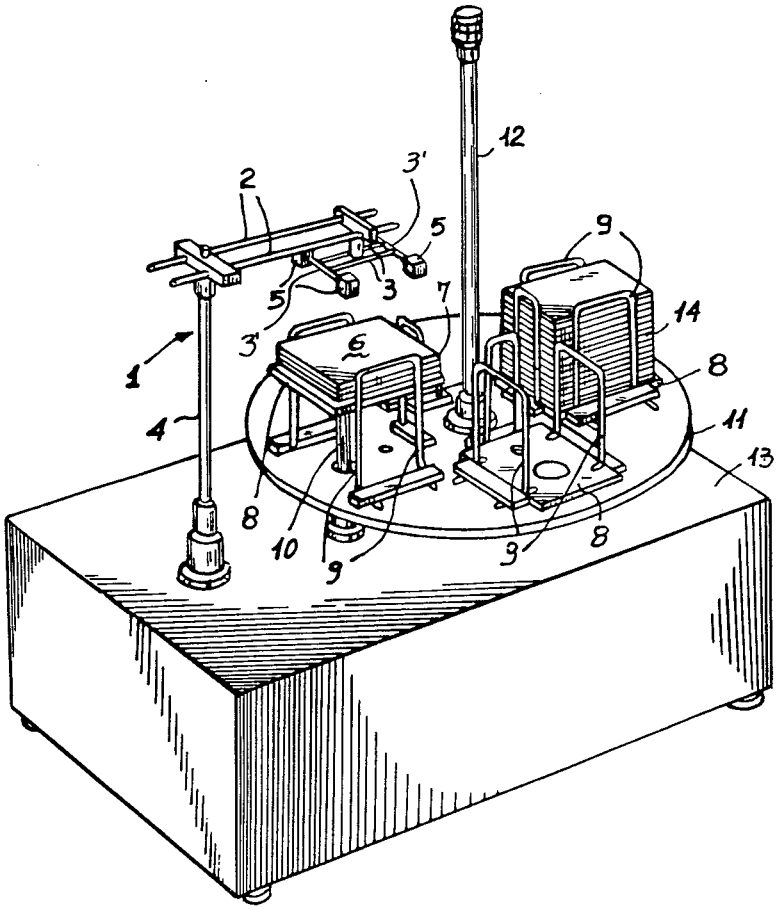
FIG. 1 is a perspective view of an apparatus for removing workpieces from a stack to which the present invention is applicable.

The invention is applicable to a unit for removing workpieces from a stack such as shown in FIG. 1 and it includes pickup heads that can be provided with gripping elements of any desired type, such as those with penetrating teeth or those defined by adhesive elements assembled thereto.

Referring now to FIG. 1, the apparatus for effecting removal of workpieces from a stack is identified generally by numeral 1 and is provided with a horizontal arm 2 having a pickup unit 3 fixed on one end thereof. The opposite end of the horizontal arm 2 is fixed on the upper end of a vertically extending rod 4 which, by means not shown, is lowered, raised and rotated during the performance of its intended function.

As shown in FIG. 1, the pickup unit 3 has four spaced pickup heads 5 mounted thereon which, when lowered with the rod 4, are caused to engage and grip the upper workpiece 6 of a stack 7. These stacks 7 of workpieces are supported on a plate 8 and are maintained in vertical alignment thereon by means of U-shaped guides 9. After the upper workpiece 6 has been gripped by the pickup heads 5, the rod 4 is raised to remove the upper workpiece from the stack 7 after which the rod 4 is rotated to a position where the removed workpiece is released. Releasing the removed workpiece in this manner permits it to drop onto a preselected location or a transport mechanism (not shown). After release of a removed workpiece, the cycle is repeated until all the workpieces have been removed from the stack 7. The pickup unit 3 is lowered and raised the same distance during each cycle and, to place the upper workpiece 6 in the necessary position to be engaged by the pickup heads 5 during each cycle, the plate 8 is raised by means of a rod 10 (FIG. 1).

A circular plate 11 is mounted for rotating movement on a vertically extending shaft 12 that is fixed on a base plate 13. Upon depletion of a stack of workpieces 7, the circular plate 11 is caused to rotate by means (not shown) until a new stack depicted by numeral 14 (FIG. 1) is moved to a position of vertical alignment with the pickup unit 3. When the new stack 14 arrives in that position aligned with the pickup head, operation is again resumed to commence independent removal of the workpieces therefrom.

Figure 4:
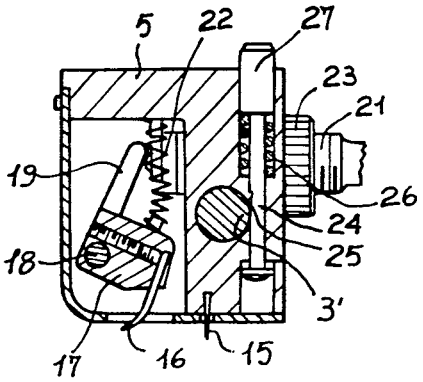
FIG. 4 is a sectional view taken along the line IV—IV in FIG. 2.
Figure 5:
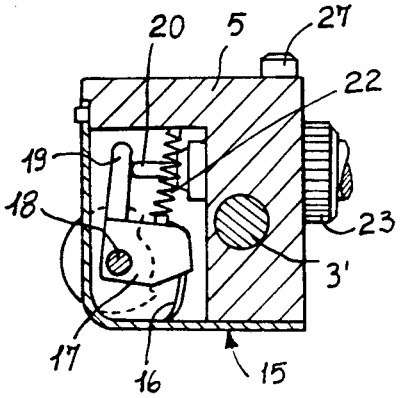
FIG. 5 is a sectional view taken along the Line V—V in FIG. 2.

As shown in FIGS. 4 and 5, each pickup head 5 is provided with at least one fixed vertical tooth 15 that projects downwardly from the lower surface of the pickup head. Additionally, each pickup head 5 includes one or more inclined teeth 16 which are movable between a retracted position within the pickup head 5 (FIG. 5) and a position where they project below the lower surface of the pickup head. These inclined teeth 16 are mounted in a block member 17 that is supported for pivotal movement on a pivot pin 18 within the pickup head 5. This block member 17 includes a projecting arm 19 located on the opposite side of the block which is provided with the inclined teeth. A piston rod 20 of a pneumatic cylinder 21, during its outward travel, pushes against the projecting arm 19 in a manner whereby the block member 17 is pivoted in a counterclockwise direction, as viewed in FIG. 5, and the inclined teeth 16 are moved to a position within the pickup head 5. When the piston rod 20 is retracted as shown in FIG. 4, a coil spring 22 inserted between the block member 17 and the upper portion of the pickup head 5 is caused to press against the block member 17 to effect pivotal movement thereof so that the inclined teeth 16 protrude beyond the lower surface of the pickup head 5. The amount the inclined teeth 16 can project from the pickup head 5 is adjustable by means of the projecting arm 19 engaging the piston rod 20 of the pneumatic cylinder which is threaded and which can be displaced axially by means of a threaded nut 23.

As shown in FIG. 1, there are four spaced pickup heads 5 mounted on bars 3' which are fixed on the latter by a clamping arrangement. This clamping arrangement is shown in FIG. 4 and includes a rod element 24 having an inclined planar surface 25 which is adapted to engage a planar surface of conforming configuration formed on each bar 3'. A coil spring 26 assembled on the rod element 24 serves to continually urge the rod in a direction whereby the inclined planar surface 25 is in locking engagement with the planar surface provided on the bar'. The locking engagement of the two planar surfaces prevents the pickup heads 5 from tilting and maintains their lower surfaces in a horizontal position. If it is necessary to change the positions of the pickup heads 5 on the bars 3' to accommodate a different size workpiece, a pushbutton 27 is provided for separating the inclined planar surfaces. This pushbutton 27 is integral with and forms one end of the rod element 24 and is effective when depressed in unlocking a pickup head 5 from a bar 3'.

When the pickup unit 3 is lowered onto a stack of workpieces 7, the fixed vertical teeth 15 on the underside of each pickup head 5 are caused to penetrate the upper workpiece 6 at which time the pneumatic cylinder 21 is activated to retract its piston rod 20, thus causing the coil spring 22 to rotate the block member 17 in a direction to cause the inclined teeth 16 to also penetrate the upper workpiece.

After the pickup unit 3 with the upper workpiece 6 has been raised and rotated, the pneumatic cylinder 21 is actuated so that its piston rod 20 pushes the projecting arm 19 in a direction to effect withdrawal of the inclined teeth from the workpiece.

It should be understood that the above described device for removing workpieces from a stack can, in place of a single support arm for the pickup heads, be formed by two or four arms arranged at 90 degrees relative to one another and can be equipped with a variable number of pickup heads.

An embodiment in which two arms are utilized can be provided with an alternating movement about the vertically extending rod so that when one pickup unit is in the process of removing a workpiece from a stack, the other unit is depositing or releasing a prior removed workpiece whereby workpieces are being deposited alternately in two separate locations.

An embodiment utilizing four arms is provided with a rotary movement in one direction whereby each pickup unit progressively removes a single workpiece while the adjacent unit is depositing one in a predetermined location.

Figure 2:
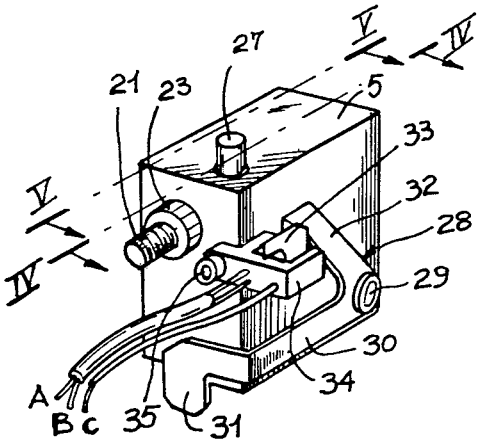
FIG. 2 is a perspective view of a pickup head with the sensing device according to the invention pivotably mounted thereon.
Figure 3:
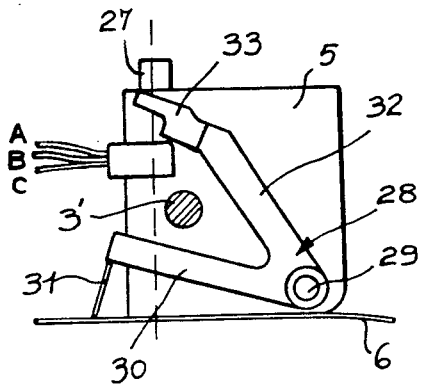
FIG. 3 is a view in side elevation of the pickup head shown in FIG. 2.

Referring now to FIGS. 2 and 3, a single pickup head 5 is shown which is provided with the sensing device according to the invention having a double armed lever generally indicated by numeral 28. This double armed lever 28 is pivotably mounted as at 29 and includes a first arm 30 that is provided with a depending plate 31 and a second arm 32 that is provided with a detector or projecting finger 33.

As shown in FIG. 2, a support bracket 34 is attached to the side of the pickup head 5 by means of a screw 35 and is adapted to support a lamp and associated photocell or optoelectronic proximity detector (not shown). The above described two armed lever associated with the photocell or detector can be replaced by any suitable sensing apparatus that will perform the same function. The lamp or light source is connected to an electrical circuit (not shown) by means of electrical leads A and B and the photocell or detector is connected by an electrical lead C to an electrical control and emergency circuit (not shown). The photocell or detector is illuminated or darkened by the lamp depending on whether the projecting arm 33 is in the raised position in FIG. 3 or in the lowered position in FIG. 2.

Upon lowering the pickup heads 5 so that they engage the upper workpiece 6, the depending plate 31 is caused to pivot upwardly which, in turn, pivots the second arm 32 and the projecting finger 33 in a like direction as shown in FIG. 3. This movement of the projecting finger 33 removes it from operative association with the photocell and initiates a signal for causing the pickup heads 5 to be raised.

After engagement and gripping of the upper workpiece 6, it is raised with the pickup head 5 and the depending plate 31 is held in an elevated position which maintains the projecting finger 33 in a position where it is unaffected by the photocell. With the projecting finger held in its elevated position, the function of the vertically extending rod 4 of raising, rotating and lowering the pickup unit 3 is uninterrupted.

If a pickup head fails to engage and grip a workpiece 6 when lowered for that purpose, the depending plate 31 will pivot downwardly as the pickup unit 3 is raised and will locate the projecting finger 33 in operative association or alignment with the photocell. With the projecting finger 33 placed in alignment with the photocell, an electrical control circuit is activated which causes the pickup head to again be lowered in an attempt to engage and grip the upper workpiece 6. A preselected number of attempts are made to engage and grip a workpiece and if these attempts fail, an emergency electrical circuit is activated to signal the operator of the condition and, if necessary, to effect a cessation of operation of the device.

For example, if the device for picking up workpieces is formed by two arms arranged at 90 degrees with respect to one another and having alternating movements so that the workpieces are deposited in two separate locations, then the emergency electrical circuit, in addition to signaling the operator of the condition, will shut down the device for picking up workpieces.

Should be device for picking up workpieces be formed with four arms at 90 degrees to one another and with continuous rotation of the arms in one direction, then upon completion of repeated movements of the pickup head, the emergency signal is given without interrupting the operation of the device for removing workpieces and which continues to operate normally using the successive arms.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A device for sensing removal of workpieces from a stack in a machine of the type having at least one pickup head with gripping members carried on a base unit for rotative movement and alternate vertical movement toward and from the upper workpiece in a stack, said device comprising:

(a) a sensing means pivotably mounted on the pickup head;

(b) means connected to said sensing means for pivoting it to an elevated position for maintaining continued operation of the machine upon engagement and gripping of a workpiece by the pickup head; and (c) means attached to said sensing means for detecting failure of the pickup head to engage and grip a workpiece upon failure of said pivoting means to pivot said sensing means to an elevated position.

2. The structure according to claim 1, wherein said sensing means defines a double armed lever (28) having a first arm (30) for supporting said pivoting means and a second arm (32) for supporting said detecting means.

3. The structure according to claim 2, wherein said pivoting means defines a depending plate (31) forming an integral part of said first arm (30).

4. The structure according to claim 2, wherein said detecting means defines a projecting finger (33) fixed on the end of said second arm (32).

5. The structure according to claim 4, wherein the pickup head includes a U-shaped support bracket (34) attached thereto for housing a light source and photocell in operative association with said projecting finger (33).

* * * * *